US010149064B2

(12) United States Patent
Lee et al.

(10) Patent No.: US 10,149,064 B2
(45) Date of Patent: Dec. 4, 2018

(54) ACOUSTIC TRANSDUCER

(71) Applicant: SAMSUNG ELECTRONICS CO., LTD., Suwon-si (KR)

(72) Inventors: Gyeong-tae Lee, Seoul (KR); Jong-bae Kim, Seoul (KR); Sung-ha Son, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 4 days.

(21) Appl. No.: 14/965,969

(22) Filed: Dec. 11, 2015

(65) Prior Publication Data

US 2017/0013366 A1 Jan. 12, 2017

(30) Foreign Application Priority Data

Jul. 6, 2015 (KR) ..... 10-2015-0095855

(51) Int. Cl.

| | |
|---|---|
| ***H04R 1/00*** | (2006.01) |
| ***H04R 9/00*** | (2006.01) |
| ***H04R 9/06*** | (2006.01) |
| ***H04R 1/32*** | (2006.01) |
| ***H04R 1/28*** | (2006.01) |

(52) U.S. Cl.

CPC ..... *H04R 9/063* (2013.01); *H04R 1/2803* (2013.01); *H04R 1/2896* (2013.01); *H04R 1/323* (2013.01); *H04R 2400/11* (2013.01); *H04R 2499/11* (2013.01); *H04R 2499/15* (2013.01)

(58) Field of Classification Search

CPC ..... H04R 1/00; H04R 2205/022; H04R 2201/401; H04R 2201/405; H04R 9/00

USPC ..... 381/182, 396, 398

See application file for complete search history.

(56) References Cited

U.S. PATENT DOCUMENTS

| | | | | |
|---|---|---|---|---|
| 4,039,044 A * | 8/1977 | Heil | H04R 1/02 | 181/199 |
| 4,042,778 A * | 8/1977 | Clinton | H04R 1/02 | 381/182 |
| 5,940,347 A | 8/1999 | Raida et al. | | |
| 6,778,677 B2 * | 8/2004 | Coffin | H04R 9/025 | 381/401 |

(Continued)

FOREIGN PATENT DOCUMENTS

| | | |
|---|---|---|
| EP | 0771133 A1 | 5/1997 |
| GB | 2416951 A | 2/2006 |

(Continued)

OTHER PUBLICATIONS

Communications dated Mar. 30, 2016, issued by the International Searching Authority in counterpart International Application No. PCT/KR2015/013788.

(Continued)

*Primary Examiner* — Suhan Ni

(74) *Attorney, Agent, or Firm* — Sughrue Mion, PLLC

(57) ABSTRACT

An acoustic transducer includes a first acoustic module and a second acoustic module. The first acoustic module includes a first motor, a first rod driven by the first motor, and a first vibrating plate connected to the first rod and vibrating. The second acoustic module includes a second motor, a second rod driven by the second motor, and a second vibrating plate connected to the second rod and vibrating. The first rod and the second rod are coaxially with each other.

16 Claims, 13 Drawing Sheets

(56) References Cited

U.S. PATENT DOCUMENTS

| | | | | |
|---|---|---|---|---|
| 8,792,672 | B2 * | 7/2014 | van Halteren | H04R 11/02 381/186 |
| 9,462,388 | B2 * | 10/2016 | Unruh | H04R 7/08 |
| 2012/0255805 | A1 | 10/2012 | van Halteren et al. | |
| 2015/0036867 | A1 | 2/2015 | Unruh et al. | |

FOREIGN PATENT DOCUMENTS

| | | | |
|---|---|---|---|
| JP | 2008-42618 | A | 2/2008 |
| WO | 0041435 | A1 | 7/2000 |
| WO | 2005122637 | A1 | 12/2005 |
| WO | 2007075674 | A2 | 7/2007 |

OTHER PUBLICATIONS

Communication dated Jun. 11, 2018, issued by the European Patent Office in counterpart European Patent Application No. 15897815.5.

* cited by examiner

ACOUSTIC TRANSDUCER

CROSS-REFERENCE TO RELATED APPLICATION

This application claims priority from Korean Patent Application No. 10-2015-0095855, filed on Jul. 6, 2015, in the Korean Intellectual Property Office, the disclosure of which is incorporated by reference herein in its entirety.

BACKGROUND

1. Field

One or more exemplary embodiments relate to an acoustic transducer.

2. Description of the Related Art

An acoustic transducer reproduces sound using vibration of a vibrating plate.

In the case of a woofer unit for reproducing low frequency sound, a large-sized vibrating plate is necessary.

Since internal space of thin electronic apparatuses, such as flat panel televisions, sound plates, or sound bars is not sufficiently large, a general woofer unit is difficult to be used. To overcome the above limitation, a linear array transducer (LAT) has been suggested.

SUMMARY

It is an aspect to provide an acoustic transducer that restricts vibration.

It is another aspect to provide an acoustic transducer that improves mechanical reliability.

It is yet another aspect to provide a thin acoustic transducer.

Additional aspects will be set forth in part in the description which follows and, in part, will be apparent from the description, or may be learned by practice of the presented exemplary embodiments.

According to an aspect of one or more exemplary embodiments, there is provided an acoustic transducer comprising a first acoustic module comprising a first motor, a first rod driven by the first motor, and a first vibrating plate connected to the first rod; and a second acoustic module comprising a second motor, a second rod driven by the second motor, and a second vibrating plate connected to the second rod, wherein the first rod and the second rod are coaxially arranged.

The first acoustic module and the second acoustic module may be arranged to face each other in an axial direction of the first and second rods.

The first and second vibrating plates may have an elongated shape with a major axis and a minor axis.

The first rod may comprise two or more first rods, and the first vibrating plate may be connected to the two or more first rods, and the second rod may comprise two or more second rods, and the second vibrating plate may be connected to the two or more second rods.

The two or more first rods and the two or more second rods may make pairs with and may be coaxial with each other.

The first acoustic module may comprise a plurality of first vibrating plates arranged in an axial direction of the first rod, and the second acoustic module may comprise a plurality of second vibrating plates arranged in an axial direction of the second rod.

The first and second vibrating plates may be respectively located inside first and second radiation cells, the first and second radiation cells may be respectively divided by the first and second vibrating plates into a first chamber and a second chamber, and first and second openings connected to an outside of the acoustic transducer may be respectively provided in the first and second chambers.

The acoustic transducer may further comprise a baffle guide that separates the first openings from the second openings.

The first and second vibrating plates may have an elongated shape with a major axis and a minor axis, and the baffle guide may separate the first openings from the second openings in a direction along the minor axis.

The first and second vibrating plates may have an elongated shape with a major axis and a minor axis, and the baffle guide may separate the first openings from the second openings in a direction along the major axis.

According to another aspect of one or more exemplary embodiments, there is provided an acoustic transducer comprising first and second radiation cells; first and second vibrating plates respectively arranged inside the first and second radiation cells; first and second rods respectively connected to the first and second vibrating plates; and first and second motors, the first and second motors respectively driving the first and second rods, wherein the first rod does not pass through the second radiation cell, and the second rod does not pass through the first radiation cells.

The first rod and the second rod may be coaxially arranged.

The first and second radiation cells may be respectively divided by the first and second vibrating plates into first and second chambers, and first and second openings connected to outside of the acoustic transducer may be respectively provided in the first and second chambers.

The acoustic transducer may further comprise a baffle guide that separates the first opening from the second opening.

The first and second vibrating plates may each have an elongated shape with a major axis and a minor axis.

The baffle guide may separate the first opening from the second opening in a direction along the minor axis.

The baffle guide may separate the first opening from the second opening in a direction along the major axis.

According to another aspect of one or more exemplary embodiments, there is provided an acoustic transducer comprising first and second rods arranged coaxially with each other; a plurality of first vibrating plates arranged in an axial direction of the first rod and connected to the first rod; a plurality of second vibrating plates arranged in an axial direction of the second rod and connected to the second rod; and first and second motors driving the first and second rods in opposite directions.

The first and second vibrating plates may have an elongated shape with a major axis and a minor axis.

BRIEF DESCRIPTION OF THE DRAWINGS

These and/or other aspects will become apparent and more readily appreciated from the following description of the exemplary embodiments, taken in conjunction with the accompanying drawings in which.

DETAILED DESCRIPTION

Figure 1:
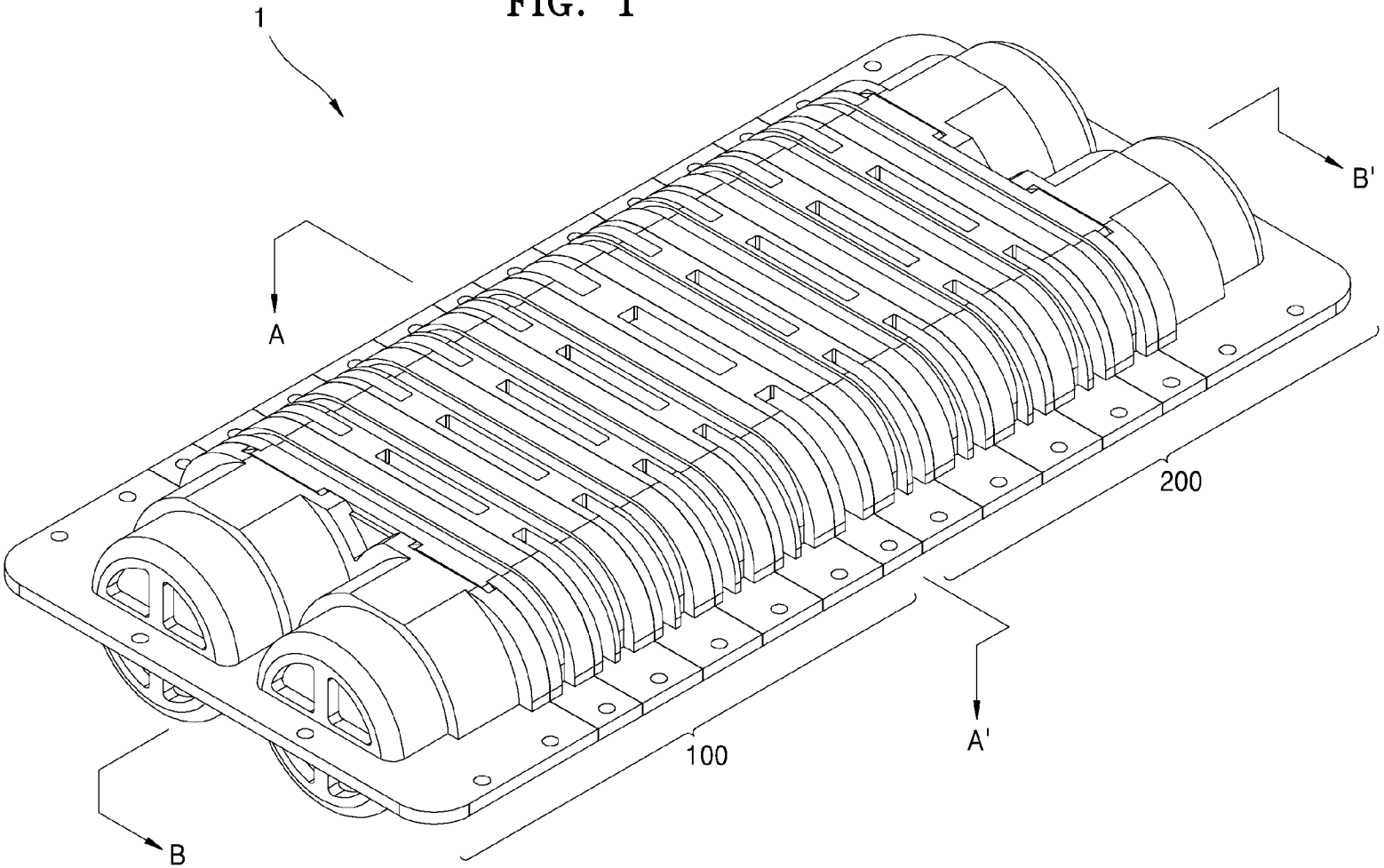
FIG. 1 is a perspective view of an acoustic transducer according to an exemplary embodiment.

Reference will now be made in detail to exemplary embodiments, examples of which are illustrated in the accompanying drawings, wherein like reference numerals refer to like elements throughout. In this regard, the present exemplary embodiments may have different forms and should not be construed as being limited to the descriptions set forth herein. Accordingly, the exemplary embodiments are merely described below, by referring to the figures, to explain aspects of the present description. As used herein, the term "and/or" includes any and all combinations of one or more of the associated listed items. Expressions such as "at least one of," when preceding a list of elements, modify the entire list of elements and do not modify the individual elements of the list.

Figure 2:
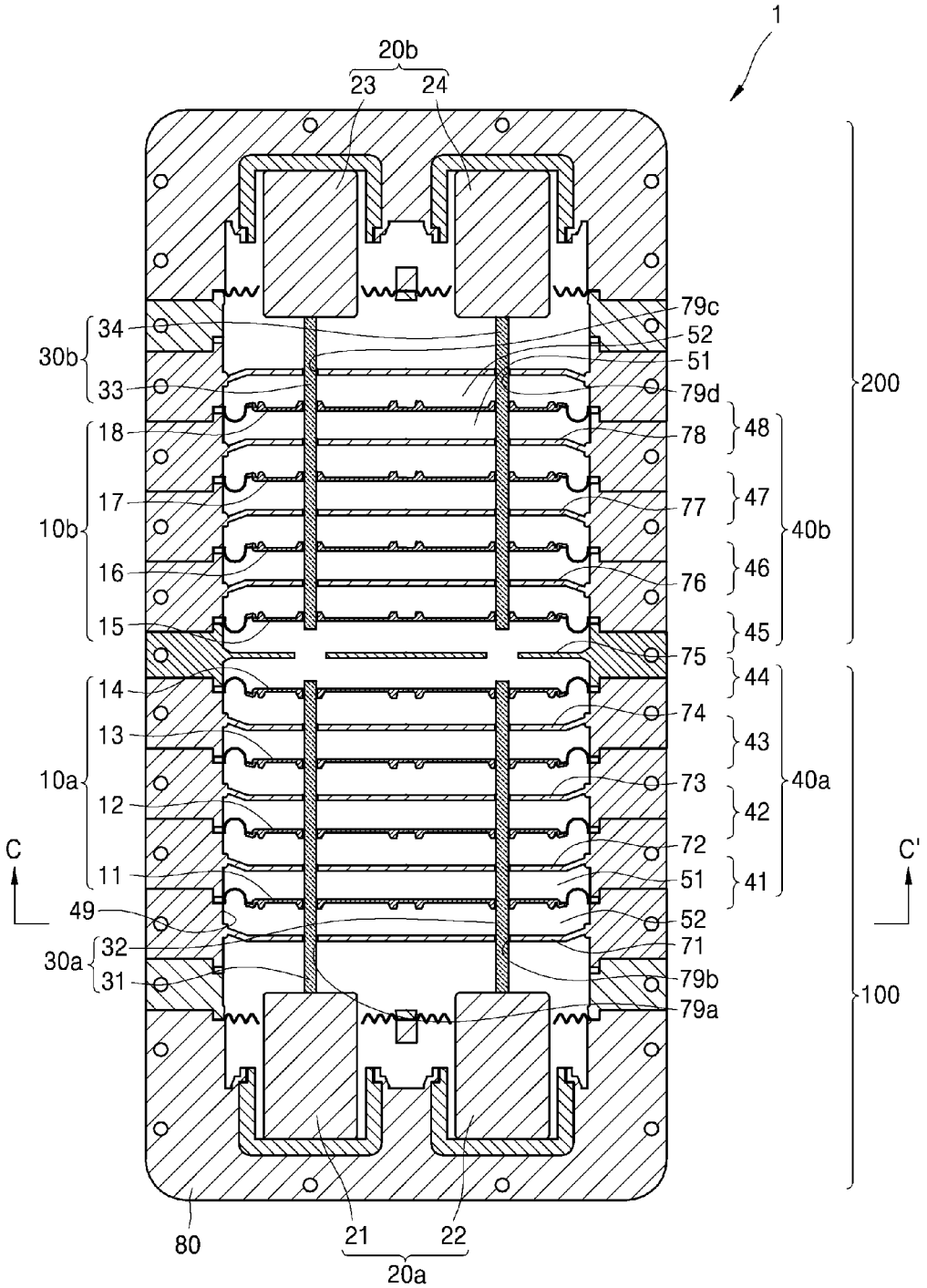
FIG. 2 is a cross-sectional view taken along a line A-A' of FIG. 1.
Figure 3:
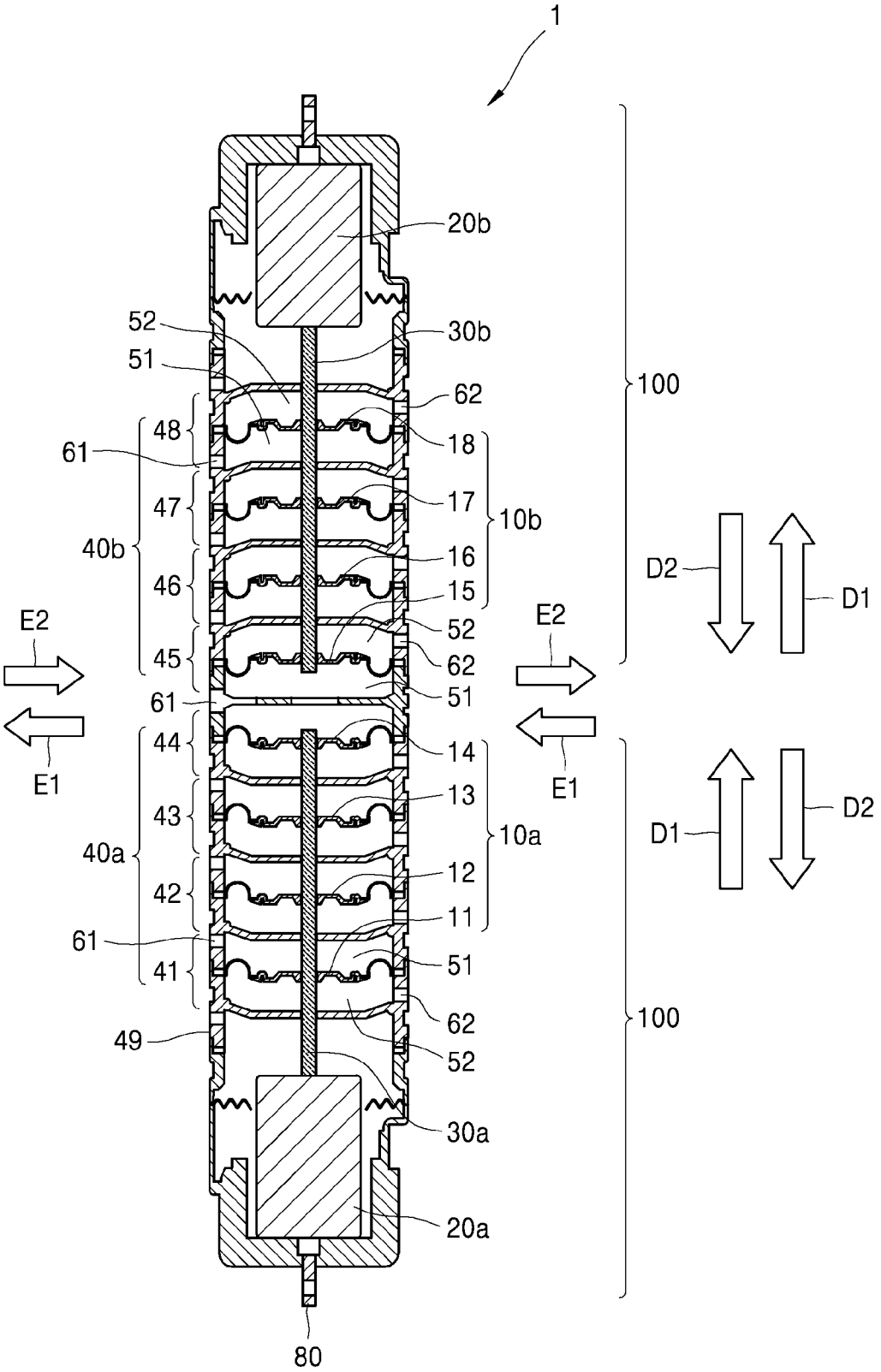
FIG. 3 is a cross-sectional view taken along a line B-B' of FIG. 1.

FIG. 1 is a perspective view of an acoustic transducer 1 according to an exemplary embodiment. FIG. 2 is a cross-sectional view taken along a line A-A' of FIG. 1. FIG. 3 is a cross-sectional view taken along a line B-B' of FIG. 1.

Referring to FIGS. 1 to 3, the acoustic transducer 1 may include a plurality of vibrating plates 11~18, a plurality of rods 31~34, and a plurality of motors 21~24. The vibrating plates 11~18 are arranged in an axial direction of the rods 31~34. The vibrating plates 11~14 (first vibrating plate 10*a*) are arranged in an axial direction of the rods 31 and 32 (first rod 30*a*) and connected to the rods 31 and 32. The vibrating plates 15~18 (second vibrating plate 10*b*) are arranged in an axial direction of the rods 33 and 34 (second rod 30*b*) and connected to the rods 33 and 34. The rods 31 and 32 are coaxial with the rods 33 and 34, respectively. The rods 31 and 32 are respectively driven by the motors 21 and 22 (first motor 20*a*), and the rods 33 and 34 are respectively driven by the motors 23 and 24 (second motor 20*b*). The first and second motors 20*a* and 20*b* drive the first and second rods 30*a* and 30*b* in opposite directions.

The vibrating plates 11~18 are respectively arranged inside radiation cells 41~48. The radiation cells 41~48 are sectioned by a plurality of partitions 71~78. Thus, for example, radiation cell 41 extends between partitions 71 and 72, and radiation cell 42 extends between partitions 72 and 73, and so on. Each of the radiation cells 41~48 is divided into a first chamber 51 and a second chamber 52 by the vibrating plates 11~18. It should be noted that, in FIG. 2, the first and second chambers 51 and 52 are only shown with respect to the radiation cell 41 in order to increase clarity. First and second openings 61 and 62 (see FIG. 3) communicating with the outside are respectively provided in the first and second chambers 51 and 52. The first and second openings 61 and 62 are located at opposite sides of the acoustic transducer 1. According to the above-described structure, the radiation cells 41~48 that are arranged in the axial direction of the rods 31~34, are sectioned by the partitions 71~78, and have the vibrating plates 11~18 arranged therein, are defined.

Figure 4:
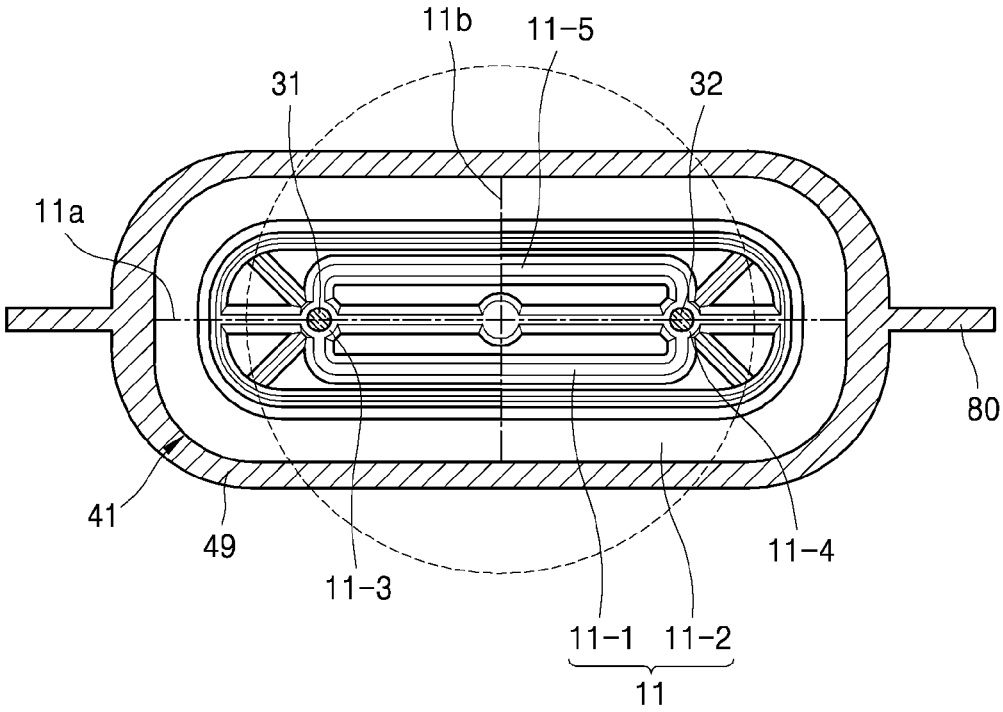
FIG. 4 is a cross-sectional view taken along a line C-C' of FIG. 2.

FIG. 4 is a cross-sectional view taken along a line C-C' of FIG. 2. Although FIG. 4 illustrates the vibrating plate 11, the following descriptions are also applied to the vibrating plates 12~18. As illustrated in FIGS. 2,3, and 4, the vibrating plates 11~18 are supported on a side wall 49 of the radiation cells 41~48. The vibrating plate 11 includes a movable plate 11-1 and a flexible membrane 11-2 that connects an edge of the movable plate 11-1 to the side wall 49 of the radiation cell 41. Connection portions 11-3 and 11-4, to which the rods 31 and 32 are respectively connected, are provided in the vibrating plate 11. A rib 11-5 to maintain rigidity of the vibrating plate 11 may be provided on the movable plate 11-1. The shape of the rib 11-5 is not limited to the example illustrated in FIG. 4. The rib 11-5 may have an appropriate shape to maintain the rigidity of the movable plate 11-1, thereby preventing generation of an undesired vibration mode in the movable plate 11-1.

The vibrating plate 11, taken as a whole, may have an elongated shape with a major axis 11*a* and a minor axis 11*b*. The vibrating plate 11 may have, for example, a rectangular shape, an ovular shape, or a trapezoidal shape. According to the vibrating plate 11 having the above shape, the acoustic transducer 1 that is slim may be implemented. In other words, as indicated by a dotted line in FIG. 4, when the vibrating plate 11 has a circular shape with an identical area, the thickness of the acoustic transducer 1 increases so as not to be applied to slim electronic apparatuses such as flat panel TVs. According to the present exemplary embodiment, since the vibrating plate 11 having an elongated shape is employed, the acoustic transducer 1 that is slim may be implemented.

The vibrating plates 11~14 respectively arranged inside the radiation cells 41~44 (first radiation cell group 40*a*) are connected to the rods 31 and 32 and driven by the motors 21 and 22. The vibrating plates 15~18 respectively arranged inside the radiation cells 45~48 (second radiation cell group 40*b*) are connected to the rods 33 and 34 and driven by the motors 23 and 24.

Each of the motors 21~24 includes a stator and a vibrator. The motors 21~24 may employ a moving coil method in which a magnet is a stator and a coil is a vibrator, or a moving magnet method in which a coil is a stator and a magnet is a vibrator. One end portions of the rods 31~34 are directly or indirectly connected to the vibrators of the motors 21~24. In other words, for example, one end portion of the rod 31 is directly or indirectly connected to the vibrator of the motor 21, and one end portion of the rod 32 is directly or indirectly connected to the vibrator of the motor 22, and so on.

The first rod 30*a* extends from the first motor 20*a*, penetrates through the first radiation cell 40*a*, that is, the radiation cells 41~44, and is connected to the first vibrating plate 10*a* located therein. Through-holes 79*a* and 79*b*, through which the rods 31 and 32 respectively pass, are provided in the partitions 71~74 that section the radiation cells 41~44. It should be noted that only the through-holes 79*a* and 79*b* are shown with respect to radiation cell 41 in FIG. 2 for clarity of description. The second rod 30*b* extends from the second motor 20*b*, penetrates through the second radiation cell 40*b*, that is, the radiation cells 45~48, and is connected to the second vibrating plate 10*b* located therein. Through-holes 79*c* and 79*d*, through which the rods 33 and 34 pass, are provided in the partitions 75~78 that section the radiation cells 45~48. Similar to the above, it should be noted that the only through-holes 79*c* and 79*d* are shown with respect to radiation cell 48 in FIG. 2 for clarity of description. The first rod 30*a* does not pass through the second radiation cell 40*b*, and the second rod 30*b* does not pass through the first radiation cell 40*a*. Accordingly, the first rod 30*a* does not penetrate through the second vibrating plate 10*b*, and the second rod 30*b* does not penetrate through the first vibrating plate 10*a*.

The first motor 20*a*, the first rod 30*a*, the first radiation cell group 40*a*, and the first vibrating plate 10*a* form a first acoustic module 100. Likewise, the second motor 20*b*, the second rod 30*b*, the second radiation cell group 40*b*, and the second vibrating plate 10*b* form a second acoustic module 200. The first and second acoustic modules 100 and 200 are located to face each other in an axial direction of the first and second rods 30*a* and 30*b*. The first and second acoustic modules 100 and 200 are complementarily driven.

For example, in FIG. 3, when the first motor 20*a* drives the first vibrating plate 10*a* in a direction D1 to reduce an inner space of the first chamber 51 of the first radiation cell group 40*a*, air in the first chamber 51 of the first radiation cell group 40*a* is discharged through the first opening 61. Simultaneously, an inner space of the second chamber 52 of the first radiation cell group 40*a* expands and thus air flows into the second chamber 52 through the second opening 62. At this time, the second motor 20*b* drives the second vibrating plate 10*b* in a direction D2 that is the opposite direction to the direction D1, and an inner space of the first chamber 51 of the second radiation cell group 40*b* is reduced. Then, air in the first chamber 51 of the second radiation cell group 40*b* is discharged through the first opening 61. Simultaneously, inner space of the second chamber 52 of the second radiation cell group 40*b* expands and thus air flows into the second chamber 52 through the second opening 62. Accordingly, the air, taken as a whole, flows in a direction E1. It should be noted that this description focuses on the operation of the radiation cell 41 and the radiation cell 48 since these cells have the first and second chambers 51 and 52 and the first and second openings 61 and 62 shown in FIG. 3, but the operation of the remaining individual radiation cells 42-44 is the same as the operation of radiation cell 41 and the operation of the remaining individual radiation cells 45-47 is the same as the operation of radiation cell 48. In other words, when the first motor 20*a* drives the first vibrating plate 10*a* in direction D1, the inner spaces of the first chambers 51 of the radiation cells of the first radiation cell group 40*a* are reduced, while the second chambers 52 of the radiation cells of the first radiation cell group 40*a* are expanded.

Conversely, when the first motor 20*a* drives the first vibrating plate 10*a* in the direction D2 to expand the inner space of the first chamber 51 of the first radiation cell group 40*a*, air flows into the first chamber 51 of the first radiation cell group 40*a* through the first opening 61. Simultaneously, the inner space of the second chamber 52 of the first radiation cell group 40*a* is reduced and thus air is discharged from the second chamber 52 through the second opening 62. At this time, the second motor 20*b* drives the second vibrating plate 10*b* in the direction D1, and the inner space of the first chamber 51 of the second radiation cell group 40*b* expands. Then, air flows into the first chamber 51 of the second radiation cell group 40*b* through the first opening 61. Simultaneously, the inner space of the second chamber 52 of the second radiation cell group 40*b* is reduced and thus air is discharged from the second chamber 52 through the second opening 62. Accordingly, the air, taken as a whole, flows in a direction E2.

As such, when the first and second acoustic modules 100 and 200 are located to face each other and are complementarily driven, a direction of an exciting force by the first acoustic module 100 and a direction of an exciting force by the second acoustic module 200 are opposite to each other. Accordingly, the sum of the exciting forces of the acoustic transducer 1 is "0". If the first and second rods 30*a* and 30*b* are deviated from each other, that is, the first and second rods 30*a* and 30*b* are not coaxial with each other, although the sum of exciting forces is "0", the sum of moments by the exciting forces is not "0". Accordingly, residual vibration may be generated in a drive process of the acoustic transducer 1. The residual vibration may cause friction between the first and second rods 30*a* and 30*b* and the partitions 71~78, that is, between the first and second rods 30*a* and 30*b* and the through-holes 79*a*, 79*b*, 79*c*, and 79*d*, and also friction between the stator and the vibrator in each of the first and second motors 20*a* and 20*b*. The friction generated between the elements of the acoustic transducer 1 may cause generation of abnormal sound and thus deteriorate operational reliability of the acoustic transducer 1.

According to the present exemplary embodiment, since the first and second rods 30*a* and 30*b* are coaxial with each other, when the acoustic transducer 1 is operated in a method in which the first and second motors 20*a* and 20*b* drive the first and second rods 30*a* and 30*b* in the opposite directions, both of the sum of the exciting forces and the sum of the moments are "0". Accordingly, the residual vibration of the acoustic transducer 1 in the drive operation may be reduced. As a result, generation of abnormal sound may be prevented and the operational reliability of the acoustic transducer 1 may be improved.

According to an acoustic transducer of a related art, the first vibrating plate 10*a* and the second vibrating plate 10*b* are alternately arranged when using the nomenclature of the present application. In other words, when using the nomenclature of the present application, the vibrating plates are arranged in an interleaved arrangement having an order of the vibrating plate 11—the vibrating plate 15—the vibrating plate 12—the vibrating plate 16—the vibrating plate 13—the vibrating plate 17—the vibrating plate 14—the vibrating plate 18. According to the related art alternate arrangement structure, the first rod 30*a* is connected to the vibrating plates 11~14 by penetrating through the vibrating plate 15, 16, and 17, and the second rod 30*b* is connected to the vibrating plates 15~18 by penetrating through the vibrating plates 14, 13, and 12. To this end, through-holes, through which the first and second rods 30*a* and 30*b* penetrate, are provided in each of the vibrating plates 12~14 and the vibrating plates 15~17. According to the related art structure, the first and second rods 30*a* and 30*b* may not be arranged coaxially. Thus, the sum of moments is not "0" so that residual vibration may be generated. Also, since the first and second rods 30*a* and 30*b* move in the opposite directions, the vibrating plates 11~14 and the vibrating plates 15~18 are moved in the opposite directions. Accordingly, as the first rod 30*a* and the through-holes of the vibrating plates 15~17, and the second rod 30*b* and the through-holes of the vibrating plates 12~14, move in the opposite direction, friction is generated therebetween and abnormal sound may be generated.

According to the acoustic transducer 1 of the present exemplary embodiment, the first vibrating plate 10*a* of the first acoustic module 100 and the second vibrating plate 10*b* of the second acoustic module 200 are spaced apart from each other and are not alternately arranged. Accordingly, the coaxial arrangement of the first and second rods 30*a* and 30*b* is possible. Also, since the first and second rods 30*a* and 30*b* drive the first and second vibrating plates 10*a* and 10*b*, respectively; the first rod 30*a* and the second vibrating plate 10*b*, and the second rod 30*b* and the first vibrating plate 10*a*, do not interfere with each other. Thus, since there is no need to form through-holes in the first and second vibrating plates 10*a* and 10*b* for the opposing rods, the structure of the first and second vibrating plates 10*a* and 10*b* are simplified and the generation of abnormal sound due to the friction between the first and second vibrating plates 10*a* and 10*b* and the second and first rods 30*b* and 30*a*, as in the acoustic transducer of a related art, may be structurally prevented.

Figure 5:
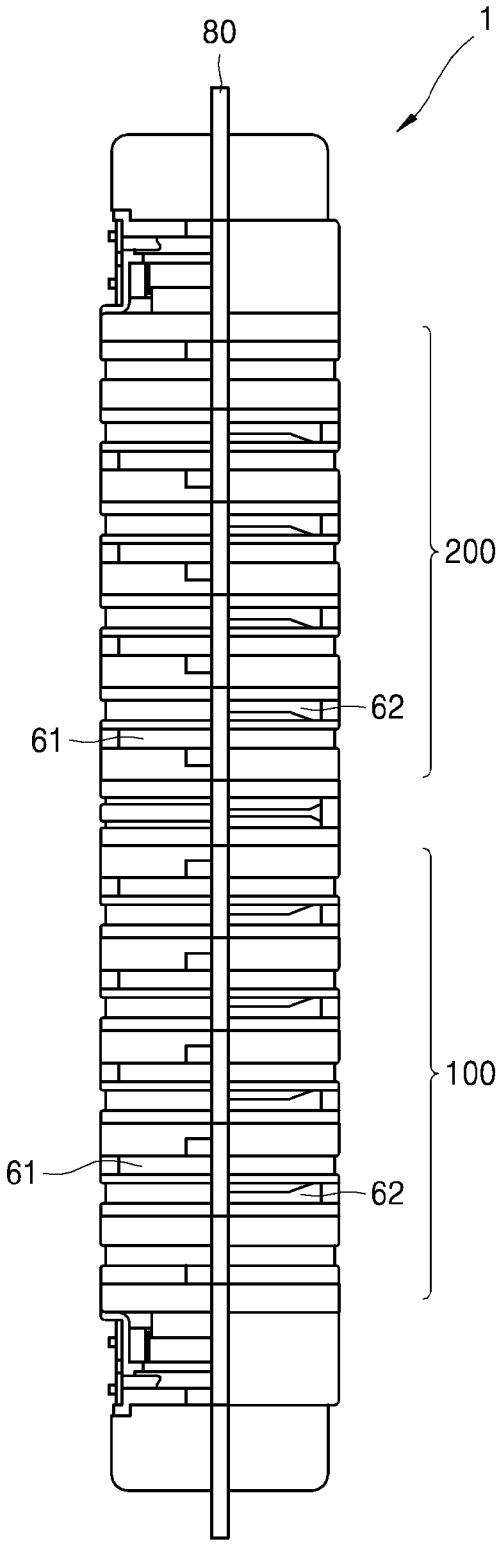
FIG. 5 is a side view of the acoustic transducer of FIG. 1.
Figure 6:
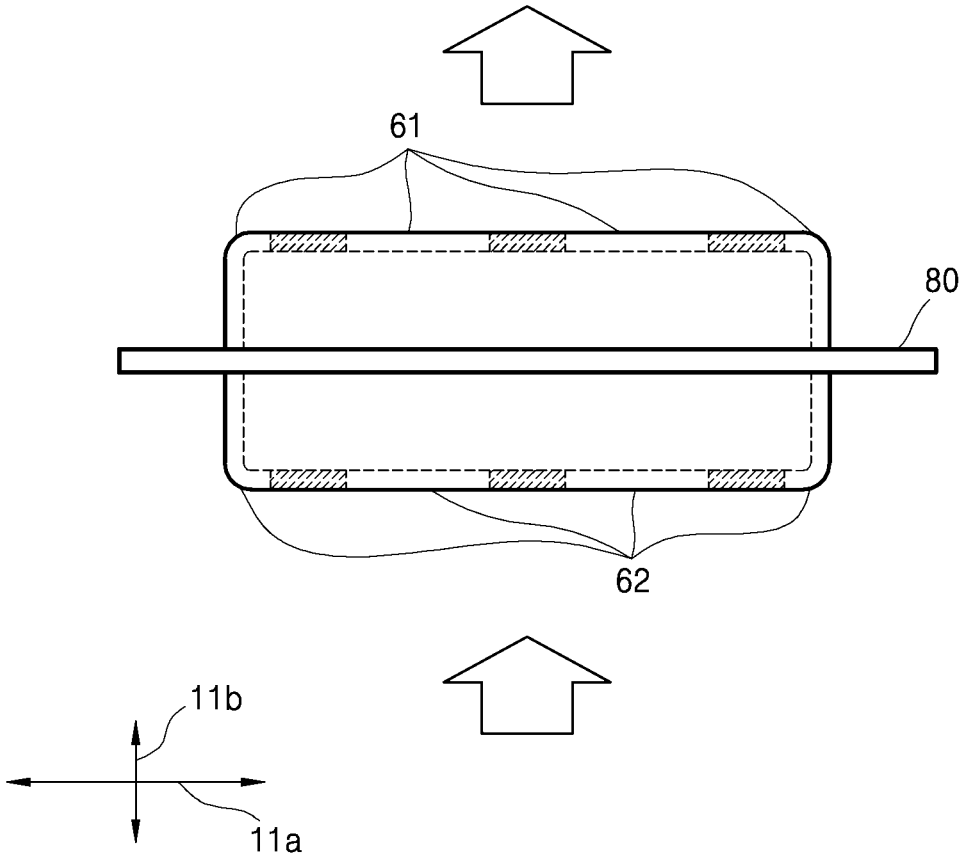
FIG. 6 is a front view schematically illustrating sound radiation by a baffle guide of FIG. 5.

FIG. 5 is a side view of the acoustic transducer 1 of FIG. 1. FIG. 6 is a front view schematically illustrating sound radiation by a baffle guide 80 of FIG. 5. Referring to FIG. 5, the acoustic transducer 1 includes a baffle guide 80. The baffle guide 80 separates the first opening 61 and the second opening 62. When the acoustic transducer 1 is driven, the phase of a sound wave through the first opening 61 is reverse to the phase of a sound wave through the second opening 62. Accordingly, when the two sound waves meet, the two sound waves are offset by each other. Accordingly, the first opening 61 and the second opening 62 are separated by the baffle guide 80. When the acoustic transducer 1 is assembled in an enclosure of an electronic apparatus, for example a housing 302 of a display device in FIG. 10, any one of the first opening 61 and the second opening 62 becomes a sound radiation hole toward the outside of the enclosure and the other is located inside the enclosure.

The baffle guide 80 of the present exemplary embodiment separates the first and second openings 61 and 62 in a direction along the minor axis 11*b* of the first and second vibrating plates 10*a* and 10*b*. That is, the baffle guide 80 extends along the major axis 11*a*. Accordingly, as illustrated in FIG. 6, sound is output in a direction along the minor axis 11*b* of the first and second vibrating plates 10*a* and 10*b*. In FIG. 6, a detailed structure of the acoustic transducer 1 is omitted, and only the first and second openings 61 and 62 and the baffle guide 80 are schematically illustrated.

Figure 7:
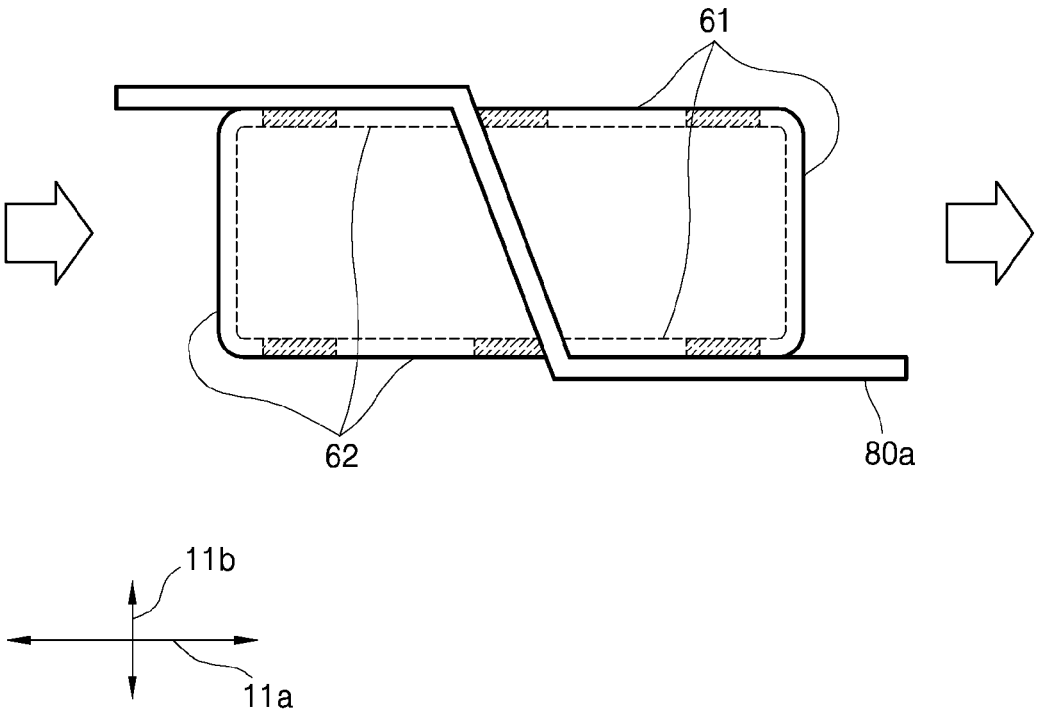
FIG. 7 is a front view of an acoustic transducer according to an exemplary embodiment.

The shape of the baffle guide 80 is not limited to the example illustrated in FIGS. 5 and 6. FIG. 7 is a front view of an acoustic transducer according to another exemplary embodiment. In FIG. 7, a detailed structure of the acoustic transducer 1 is omitted, and only the first and second openings 61 and 62 and a baffle guide 80*a* are schematically illustrated. Referring to FIG. 7, the baffle guide 80*a* separates the first and second openings 61 and 62 in a direction along the major axis 11*a* of the first and second vibrating plates 10*a* and 10*b*. According to the above structure, sound is output in a direction along the major axis 11*a* of the first and second vibrating plates 10*a* and 10*b*.

As described above, by employing a baffle guide having various shapes, the acoustic transducer 1 may be appropriately arranged to occupy space as small as possible in an electronic apparatus according to the shape of the electronic apparatus employing the acoustic transducer 1.

Although in the above-described exemplary embodiments each of the first and second acoustic modules 100 and 200 includes four vibrating plates, the number of vibrating plates may vary according to the output of the acoustic transducer 1. Accordingly, the number of vibrating plates of each of the first and second acoustic modules 100 and 200 may be greater or less than four. It should be noted that when the numbers of vibrating plates of the first and second acoustic modules 100 and 200 are the same, the sum of exciting forces is "0".

Figure 8:
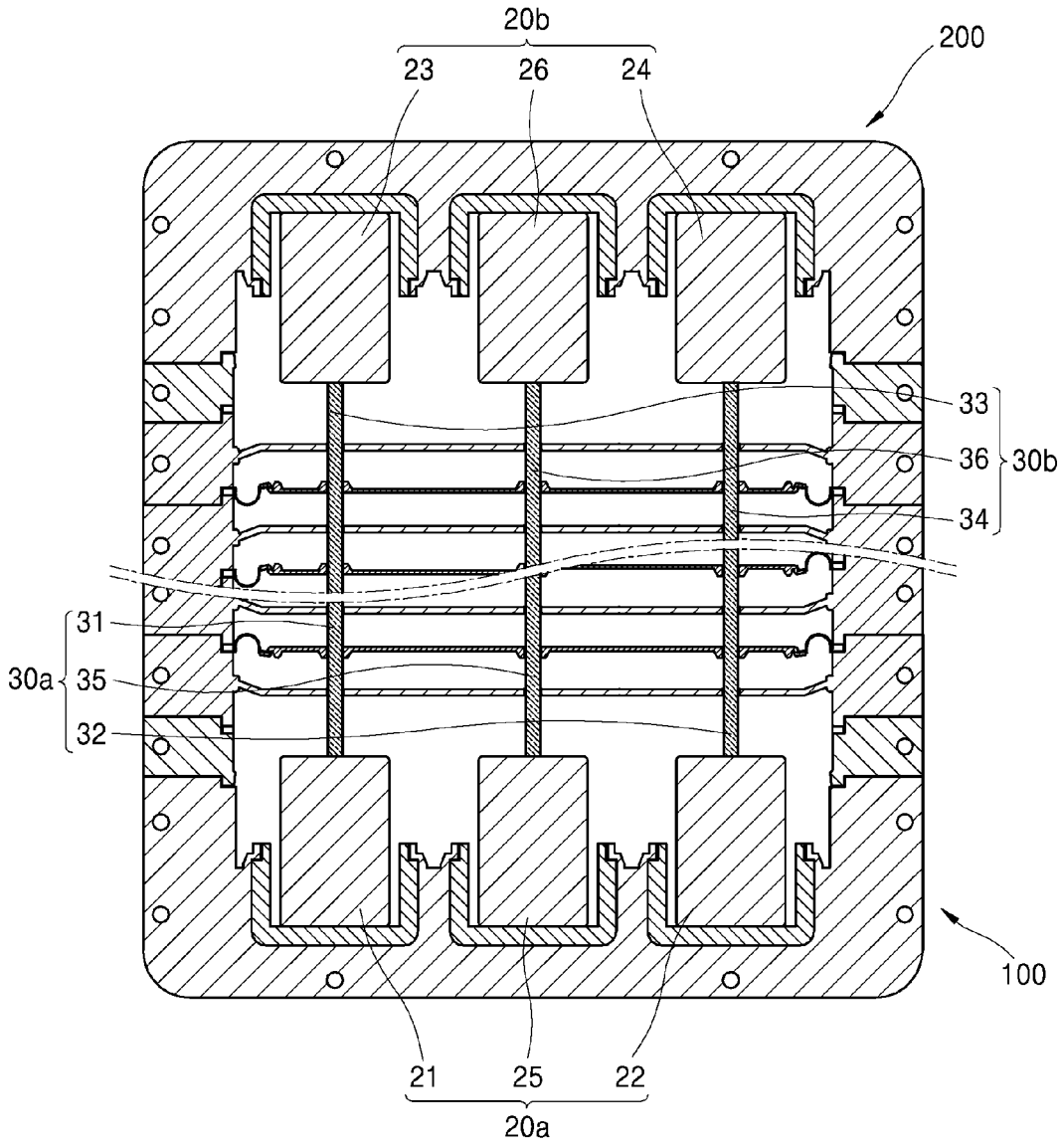
FIG. 8 is a plan view of an acoustic transducer according to an exemplary embodiment.

Although in the above-described exemplary embodiments each of the first and second acoustic modules 100 and 200 employs two rods, the number of rods may be one, or three or more as illustrated in FIG. 8. Referring to FIG. 8, the first acoustic module 100 includes three rods 31, 32, and 35 and three motors 21, 22, and 25 for driving the three rods 31, 32, and 35, respectively. The second acoustic module 200 includes three rods 33, 34, and 36 and three motors 23, 24, and 26 for driving the three rods 33, 34, and 36, respectively. The rods 31, 32, and 35 make pairs with and are coaxial with the rods 33, 34, and 36, respectively. That is, rod 31 and rod 33 may form a pair, rod 32 and rod 34 may form a pair, and rod 35 and rod 36 may form a pair.

Figure 9:
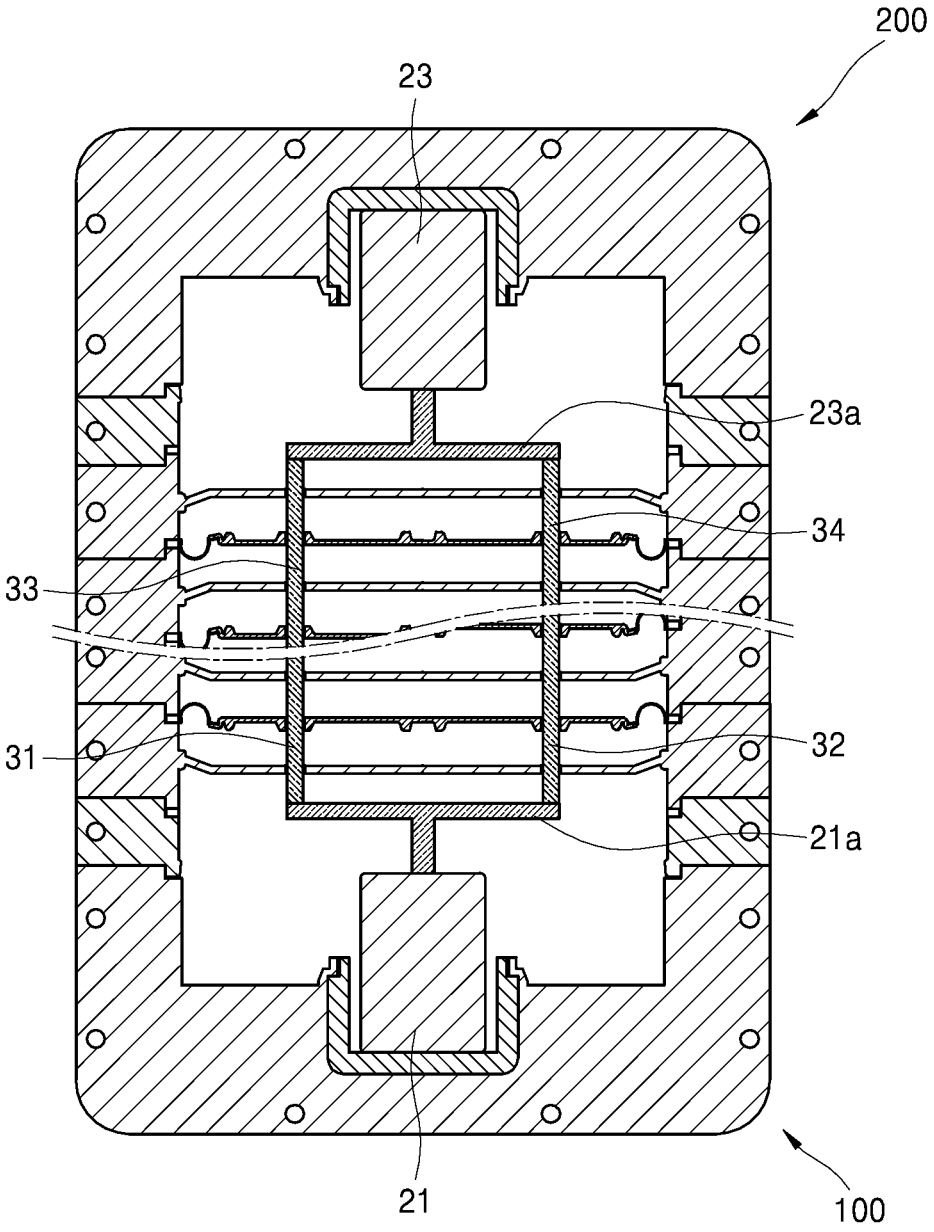
FIG. 9 is a plan view of an acoustic transducer according to an exemplary embodiment.

Also, although in the above-described exemplary embodiment a structure in which the rods 31~34 are respectively driven by the motors 21~24, that is, the rod and the motor make a pair, is described, a structure in which two or more rods are driven by one motor may be possible. Referring to FIG. 9, the rods 31 and 32 of the first acoustic module 100 are driven by the motor 21, and the rods 33 and 34 of the second acoustic module 200 are driven by the motor 23. For example, a connection member 21*a* connected to a vibrator (not shown) is provided at the motor 21, and one end portions of each of the rods 31 and 32 may be connected to the connection member 21*a*. Likewise, a connection member 23*a* connected to a vibrator (not shown) is provided at the motor 23, and one end portion of each of the rods 33 and 34 may be connected to the connection member 23*a*. The rods 31 and 32 are coaxial with the rods 33 and 34, respectively. Also, vibration axes of the motors 21 and 23 are also coaxial with each other.

The acoustic transducer 1 of the present exemplary embodiments may be applied to a variety of electronic apparatuses. For example, the acoustic transducer 1 may be applied to electronic apparatuses, for example, sound bars or display apparatuses such as flat panel televisions or monitors, for which slimming or miniaturizing are advantageous. For example, the acoustic transducer 1 may be employed as a woofer system of an electronic apparatus.

Figure 10:
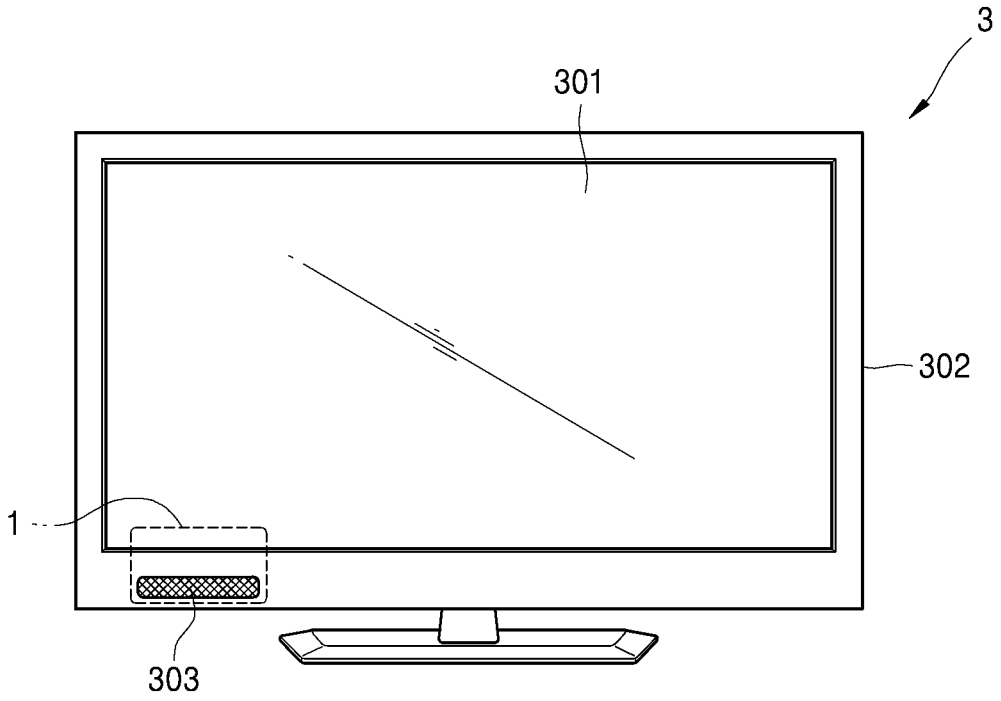
FIG. 10 is a schematic front view of an example of a display apparatus employing an acoustic transducer.

FIG. 10 is a schematic front view of an example of a display apparatus employing the acoustic transducer 1. Referring to FIG. 10, a display apparatus 3 includes a housing 302 that accommodates a flat panel display 301. The housing 302 includes a sound radiation hole 303. In FIG. 10, the sound radiation hole 303 may be provided in a front or rear surface of the housing 302. The acoustic transducer 1 is arranged inside the housing 302. The acoustic transducer 1 may radiate sound forwardly from the display apparatus 3 through the sound radiation hole 303. In this case, the acoustic transducer 1 may have a structure of outputting sound in the direction along the minor axis 11*b* by employing, for example, the baffle guide 80 having a linear shape as illustrated in FIGS. 5 and 6. As a result, the display apparatus 3 may be made slim, when taken as a whole.

Figure 11:
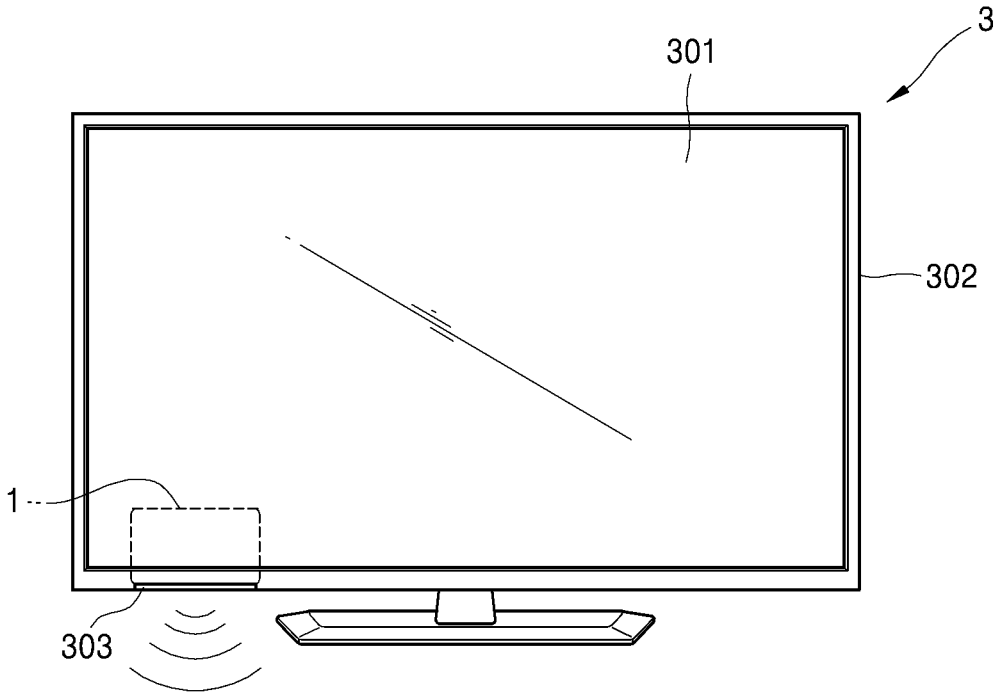
FIG. 11 is a schematic front view of another example of a display apparatus employing an acoustic transducer.

FIG. 11 is a schematic front view of another example of a display apparatus employing the acoustic transducer 1. Referring to FIG. 11, the display apparatus 3 includes the housing 302 that accommodates the flat panel display 301. The sound radiation hole 303 is provided in the housing 302. As illustrated in FIG. 11, when a width of an edge between the housing 302 and the display 301 is narrow, the sound radiation hole 303 may be provided on a lower or side surface of the housing 302. In this case, the acoustic transducer 1 may employ the baffle guide 80*a* having a "Z" shape as illustrated in FIG. 7 and may radiate sound in the direction along the major axis 11*a*. The acoustic transducer 1 having the above structure may be employed in the display apparatus 3 having a narrow edge so as to radiate sound downward or sideways from the display apparatus 3. A degree of freedom of design of the display apparatus 3 may be extended. The sound radiation hole 303 may have a slit radiation structure to radiate sound forward or rearward.

Figure 12:
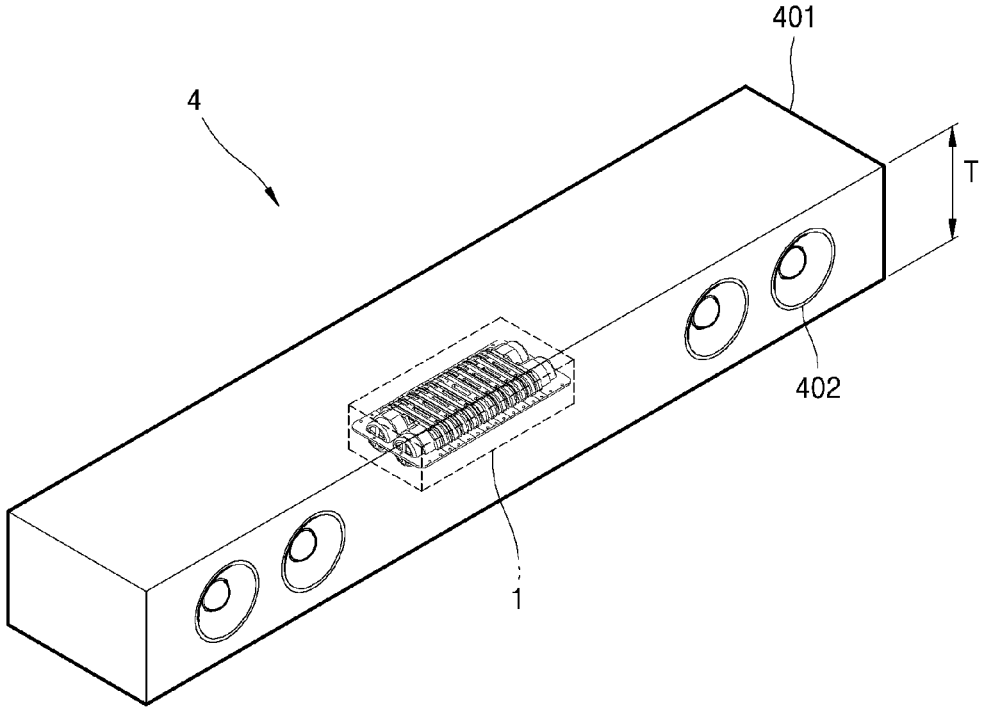
FIG. 12 is a schematic front view of an example of a sound bar employing an acoustic transducer.

FIG. 12 is a schematic front view of an example of a sound bar 4 employing the acoustic transducer 1. In the present exemplary embodiment, the acoustic transducer 1 is employed as a woofer system. Referring to FIG. 12, a housing 401 of a sound bar 4 accommodates one or more speakers 402 reproducing sound of various frequency ranges and the acoustic transducer 1. In this case, a radiation woofer system may be implemented by employing the baffle guide 80 having a linear shape as illustrated in FIGS. 5 and 6. A forward radiation woofer system may be implemented by employing the baffle guide 80*a* having a "Z" shape as illustrated in FIG. 7. According to the above structure, a thickness T of the sound bar 4 may be reduced and thus the sound bar 4 or a sound plate having a slim shape with an integrated woofer system may be implemented.

Figure 13:
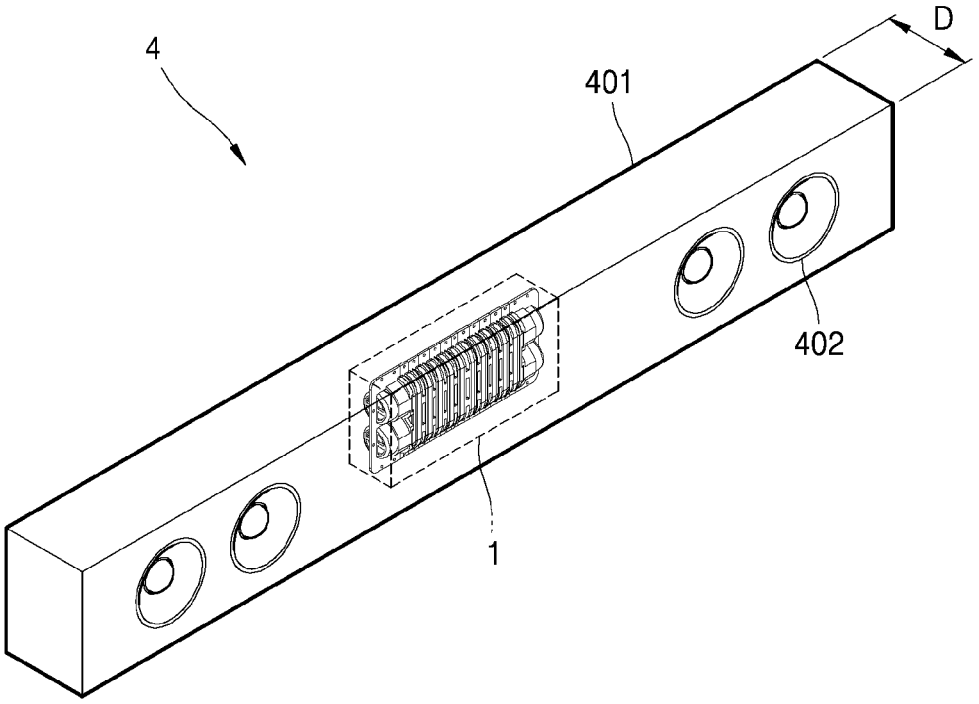
FIG. 13 is a schematic front view of another example of a sound bar employing an acoustic transducer.

Also, as illustrated in FIG. 13, the acoustic transducer 1 may be arranged by being erected. In this case, a forward radiation woofer system may be implemented by employing the baffle guide 80 having a linear shape as illustrated in FIGS. 5 and 6. A downward or sideways radiation woofer system may be implemented by employing the baffle guide 80*a* having a "Z" shape as illustrated in FIG. 7. According to the above structure, a depth D of the sound bar 4 may be reduced and thus a linear-type sound bar with an integrated woofer system may be implemented.

Although in the above-described exemplary embodiments a display apparatus and a sound bar are described as examples of electronic apparatuses, the electronic apparatuses may include personal computers (PCs), notebook computers, mobile phone, tablet PCs, navigation terminals, smartphones, personal digital assistants (PDAs), portable multimedia players (PMPs), and digital broadcast receivers. These are merely exemplary and the electronic apparatuses may be interpreted to be a concept including all apparatuses capable of communicating that are currently developed and commercialized or will be developed in the future, in addition to the above examples.

It should be understood that exemplary embodiments described herein should be considered in a descriptive sense only and not for purposes of limitation. Descriptions of features or aspects within each exemplary embodiment should typically be considered as available for other similar features or aspects in other exemplary embodiments.

While various exemplary embodiments have been described with reference to the figures, it will be understood by those of ordinary skill in the art that various changes in form and details may be made therein without departing from the spirit and scope as defined by the following claims.

What is claimed is:

1. An acoustic transducer comprising:

a first acoustic module comprising a first motor, a first rod driven by the first motor, and a first vibrating plate connected to the first rod; and a second acoustic module comprising a second motor, a second rod driven by the second motor, and a second vibrating plate connected to the second rod, wherein the first rod and the second rod extend along a same axis and are separated from each other along the same axis, and wherein the first and second vibrating plates are respectively located inside first and second radiation cells, and wherein the first rod comprises two or more first rods, and the first vibrating plate is connected to the two or more first rods, and the second rod comprises two or more second rods, and the second vibrating plate is connected to the two or more second rods.

2. The acoustic transducer of claim 1, wherein the first acoustic module and the second acoustic module are arranged to face each other in an axial direction of the first and second rods.

3. The acoustic transducer of claim 2, wherein the first and second vibrating plates have an elongated shape with a major axis and a minor axis.

4. The acoustic transducer of claim 1, wherein the two or more first rods and the two or more second rods make pairs with and are coaxial with each other.

5. The acoustic transducer of claim 3, wherein the first acoustic module comprises a plurality of first vibrating plates arranged in an axial direction of the first rod, and the second acoustic module comprises a plurality of second vibrating plates arranged in an axial direction of the second rod.

6. The acoustic transducer of claim 3, wherein the first and second radiation cells are respectively divided by the first and second vibrating plates into a first chamber and a second chamber, and first and second openings connected to an outside of the acoustic transducer are respectively provided in the first and second chambers.

7. The acoustic transducer of claim 6, further comprising a baffle guide that separates the first openings from the second openings.

8. The acoustic transducer of claim 7, wherein the first and second vibrating plates have an elongated shape with a major axis and a minor axis, and the baffle guide separates the first openings from the second openings in a direction along the minor axis.

9. The acoustic transducer of claim 7, wherein the first and second vibrating plates have an elongated shape with a major axis and a minor axis, and the baffle guide separates the first openings from the second openings in a direction along the major axis.

10. An acoustic transducer comprising:

first and second radiation cells;

first and second vibrating plates respectively arranged inside the first and second radiation cells;

first and second rods respectively connected to the first and second vibrating plates; and first and second motors, the first and second motors respectively driving the first and second rods, wherein the first rod does not pass through the second radiation cell, and the second rod does not pass through the first radiation cells, wherein the first rod and the second rod are coaxially arrange, wherein the first and second radiation cells are respectively divided by the first and second vibrating plates into first and second chambers, and first and second openings connected to outside of the acoustic transducer are respectively provided in the first and second chambers.

11. The acoustic transducer of claim 10, further comprising a baffle guide that separates the first opening from the second opening.

12. The acoustic transducer of claim 11, wherein the first and second vibrating plates each has an elongated shape with a major axis and a minor axis.

13. The acoustic transducer of claim 12, wherein the baffle guide separates the first opening from the second opening in a direction along the minor axis.

14. The acoustic transducer of claim 12, wherein the baffle guide separates the first opening from the and second opening in a direction along the major axis.

15. An acoustic transducer comprising:

first and second rods extending along a same axis and separated from each other along the same axis;

a plurality of first vibrating plates arranged in an axial direction of the first rod and connected to the first rod;

a plurality of second vibrating plates arranged in an axial direction of the second rod and connected to the second rod; and first and second motors driving the first and second rods in opposite directions, wherein the first vibrating plates are respectively located inside first radiation cells, and the second vibrating plates are respectively located inside second radiation cells, and wherein the first rod comprises two or more first rods, and the plurality of first vibrating plates are connected to the two or more first rods, and the second rod comprises two or more second rods, and the plurality of second vibrating plates are connected to the two or more second rods.

16. The acoustic transducer of claim 15, wherein the first and second vibrating plates have an elongated shape with a major axis and a minor axis.

* * * * *